United States Patent [19]

Seanor

[11] 4,272,179

[45] Jun. 9, 1981

[54] METAL-FILLED ELASTOMER FUSER MEMBER

[75] Inventor: Donald A. Seanor, Pittsford, N.Y.

[73] Assignee: Xerox Corporation, Stamford, Conn.

[21] Appl. No.: 26,989

[22] Filed: Apr. 4, 1979

[51] Int. Cl.[3] ..... B05C 11/02; B21B 31/08

[52] U.S. Cl. ..... 355/3 FU; 29/132; 219/216; 219/388; 430/98; 430/99; 432/60; 432/228

[58] Field of Search ..... 29/132; 430/98, 99; 118/60, 101; 432/60, 228; 355/3 FU; 219/216, 388

[56] References Cited

U.S. PATENT DOCUMENTS

| | | | |
|---|---|---|---|
| 2,970,906 | 2/1961 | Bixby | 250/315 A X |
| 3,002,927 | 10/1961 | Awe et al. | 252/37.2 |
| 3,098,836 | 7/1963 | Bobear | 260/37 SB |
| 3,435,500 | 4/1969 | Aser et al. | 29/130 |
| 3,669,707 | 6/1972 | Donnelly et al. | 427/444 |
| 3,852,861 | 12/1974 | Baker et al. | 29/132 |
| 3,884,950 | 5/1975 | Koda et al. | 260/45.7 R X |
| 3,937,637 | 2/1976 | Moser et al. | 148/6 |
| 3,942,230 | 3/1976 | Nalband | 29/132 |
| 4,011,362 | 3/1977 | Stewart | 428/447 |
| 4,029,827 | 6/1977 | Imperial et al. | 427/314 R X |
| 4,046,795 | 9/1977 | Martin | 260/448.2 E |
| 4,064,313 | 12/1977 | Takiguchi et al. | 428/447 |
| 4,078,285 | 3/1978 | Seanor | 29/132 |
| 4,078,286 | 3/1978 | Takiguichi et al. | 29/132 |
| 4,083,092 | 4/1978 | Imperial et al. | 29/132 |
| 4,101,686 | 7/1978 | Strella et al. | 29/132 X |

OTHER PUBLICATIONS

Abstract in Derwents "Electrophotography" for W. German 2,824,994.

Abstract in Derwents "Electrophotography" for Japanese Patent Application J53089-743.

Research Disclosures, Product Licensing Index, Jul. 1972, pp. 72-73.

Viton Fluoroelastomer Cross linking by Bisphenols, W. W. Schmiegle, paper presented at S. German, Apr. 28-29, 1977, Deutsche Kautschuk und G. G.

Conductive Polymeric Compositions, D. M. Bigg PES 12/1977, vol. 17, No. 12, pp. 842-847.

RPN Technical Notebook, Sep. 18, 1978.

*Primary Examiner*—Ronald H. Smith

*Assistant Examiner*—Thurman K. Page

[57] ABSTRACT

A fuser member and method of fusing or fixing thermoplastic resin powder images to a substrate in a fuser assembly of the type wherein a polymeric release agent having functional groups is applied to the surface of the fuser member is disclosed. The fuser member comprises a base member having an elastomer surface with metal-containing filler therein. Metal containing fillers include metals, metal alloys, metal oxides and metal salts. Exemplary of such a fuser member is an aluminum base member coated with poly(vinylidene fluoride-hexafluoropropylene) copolymer having lead oxide filler dispersed therein and utilizing mercapto-functional polyorganosiloxane as a release agent.

56 Claims, 2 Drawing Figures

METAL-FILLED ELASTOMER FUSER MEMBER

This invention relates generally to heat fusing members, assemblies and methods, and more particularly, to an improved fusing surface and method to prevent offsetting of a resin-based powder fused upon a substrate during the fusing operation. As used herein, the fusing surface may be a roll, a belt, a flat surface or any other shape suitable for fixing toner or resin-based powder images. The invention is particularly useful in the field of xerography where images are electrostatically formed and developed with resinous powders known as toners or thermoplastic resin powders, and thereafter fused or fixed onto sheets of paper or other substrates to which the powder images have been transferred. The resin-based powders or toners of this invention are heat softenable, such as those provided by toners which contain thermoplastic resins and used conventionally in a variety of commercially known methods.

In order to fuse images formed of the resinous powders or toners, it is necessary to heat the powder and the substrate to which it is to be fused, to a relatively high temperature, generally in excess of about 90° C. This will vary depending upon the softening range of the particular resin used in the toner. Generally, even higher temperatures are contemplated such as approximately 160° C. or higher. It is undesirable, however, to raise the temperature of the substrate substantially higher than about 200° C. because of the tendency of the substrate to discolor at such elevated temperatures, particularly when the substrate is paper.

It has long been recognized that one of the fastest and most positive methods of applying heat for fusing the powder image is direct contact of the resin-based powder with a hot surface, such as a heated roll. But, in most instances, as the powder image is tackified by heat, part of the image carried by the support material will stick to the surface of the plate or roll so that as the next sheet is advanced on the heated roll, the tackified image, partially removed from the first sheet, will partly transfer to the next sheet and at the same time part of the tackified image from said next sheet adheres to the heated roll. This process is commonly referred to in the art as "offset" of "hot offset", terms now well-known in the art.

The offset of toner onto the heated surface led to the development of improved methods and apparatus for fusing the toner image. These improvements comprised fusing toner images by forwarding the sheet or web or substrate material bearing the image between two rolls at least one of which was heated, the rolls contacting the image being provided with an abhesive surface such as a thin coating of tetrafluoroethylene resin and a silicone oil film to prevent toner offset. The outer surfaces of such rolls have also been fabricated of fluorinated ethylene/propylene polymers, elastomers which contain hexafluoropropylene as a comonomer such as poly(vinylidene fluoride/hexafluoropropylene) or silicone elastomers coated with silicone oil as well as silicone elastomers containing low surface energy fillers such as fluorinated organic polymers, and the like. The tendency of these rolls to pick up the toner generally requires some type of release fluid continuously applied to the surface of the roll to prevent hot offset, and commonly known slicone oils are generally well adapted for this purpose. Bare metal fuser members having functionalized polymeric release agents upon their surfaces are also well-known in the art. The functionalized polymeric release agents, such as mercapto-functional polyorganosiloxanes, are generally well adapted for release of thermoplastic resin toner from the heated surfaces of bare metal fuser members.

Although the foregoing fuser members used in conjunction with various fuser release agents have been successfully used to fuse thermoplastic resin toners to various substrates, each of the prior art combinations has various disadvantages. For example, many of the prior art systems are incapable of fusing toner images to substrates at high speeds. Others consume large amounts of expensive fuser oil or fuser release agent. Still other prior art fusing systems compromise copy quality even though they are capable of fusing large numbers of copies. Many of the fuser member structures are subject to wear and degradation due to continued operation at elevated temperatures. This necessitates replacement of the fuser member which is quite costly when a large number of machines are involved. Moreover, many of the fuser members having elastomeric and resinous layers of material along with a coating of silicone oil to prevent toner offset are of sufficient thickness to constitute a poor thermal conductor, and longer nip dwell and higher fuser roll temperatures are required to deliver the fusing energy required to fix toner. Also, control of the surface temperature of the roll presents a problem due to large temperature variations occurring before and after contacting of the substrate bearing the images.

OBJECTS OF THE INVENTION

Accordingly, it is the principle object of this invention to provide a fuser member and method for rapidly fixing resinous powder images at high speeds without causing offset or hot offset.

Another object of this invention is to provide a fuser member with an elastomer or resin surface wherein the elastomer or resin is fortified with a high energy filler to promote release and prevent hot offset when used in conjunction with specified functional release agents.

It is another object of this invention to provide a fuser member and method of fusing wherein the surface layer of the fuser member has excellent thermal conductivity.

Still another object of this invention is to provide a fuser member and method of fusing whereby there is an interaction between the elastomer or resinous surface material of the fuser member and the fuser release agent or fuser oil applied to the surface thereof.

Other objects and advantages of the present invention will become apparent when read in conjunction with the accompanying drawings and specification.

SUMMARY OF THE INVENTION

The above-cited objects of the invention are accomplished by applying a polymeric release agent having functional groups to the surface of a fuser member comprising a base member and an elastomer surface, the elastomer having metal-containing filler dispersed therein. The metal-containing filler dispersed in the elastomer must be present in an amount sufficient to interact with the polymeric release agent having functional groups on the surface of the fuser member. The fuser member which may be a roll, a belt, a flat surface or other substrate having a suitable shape for fixing thermoplastic resin powder images to a substrate comprises a base member having an elastomer surface, said elastomer having a metal-containing filler, such as a metal, metal alloy, metal salt or metal oxide, dispersed therein in an amount sufficient to interact with a polymeric release agent having functional groups, said polymeric release agent being applied to the elastomer surface to provide a surface abhesive to the thermoplastic resin toner or powder. Thus, there is provided a fuser member for fixing thermoplastic resin powder images to a substrate in a fuser assembly of the type wherein a polymeric release agent having functional groups is applied to the surface of the fuser member, comprising a base member having an elastomer working surface said elastomer having a metal-containing filler dispersed therein in an amount sufficient to interact with a polymeric release agent having functional groups.

There is also provided a method of fusing thermoplastic resin toner images to a substrate comprising: (a) forming a film of polymeric release agent having functional groups on the elastomer surface of a fuser member at elevated temperatures, said elastomer surface having metal-containing filler dispersed therein in an amount sufficient to interact with the polymeric release agent having functional groups; (b) contacting the toner images on the substrate with the coated, heated elastomer surface for a period of time sufficient to soften the toner; and (c) allowing the toner to cool. The thermoplastic resin powder is fixed to the substrate by contacting the substrate bearing the thermoplastic resin powder image with the heated surface of the described elastomer containing metal oxide, metal salt, metal or metal alloy filler and covered with a polymeric release agent having functional groups for a time and at a temperature sufficient to permit the fusion of the thermoplastic resin powder to the substrate. The elastomer surface having metal oxide, metal salt, metal, metal alloy or other suitable metal compound filler dispersed therein is abhesive to tackified or molten thermoplastic resin powder undergoing fusion on the substrate because the elastomer having metal oxide, metal salt, metal, metal alloy or other suitable metal compound filler dispersed therein bears a film of polymeric release agent having functional groups which have interacted with the metal, metal alloy, metal salt, metal oxide or other suitable metal compound filler of the elastomer. Because of the synergism between the elastomer having metal oxide, metal salt, metal, metal alloy or other suitable metal compound filler dispersed therein and the polymeric release agent having functional groups, excellent release and the production of high quality copies are obtained even at high rates of speed of electrostatic reproducing machines.

In another improvement of this invention, it has been discovered that when elastomers are cured by a special curing or crosslinking agent or process, and the elastomer has incorporated therein a metal-containing filler in accordance with the present invention, there is not only the realization of the fusing or fixing of a large number of copies, that is the improved release, but there is also a substantial improvement in wear rate over the elastomers cured by conventional curing or crosslinking agents, for example free radical initiator agents such as peroxides. Thus, when elastomers such as fluoroelastomers are cured by a nucleophilic addition curing or crosslinking system, and the fluoroelastomer contains a metal-containing filler in accordance with the present invention, a superior fuser member and method of fusing are obtained. There is provided a fuser member for fixing thermoplastic resin powder images to a substrate in a fuser assembly of the type wherein a polymeric release agent having functional groups is applied to the surface of the fuser member, the fuser member comprising a base member having an elastomer surface with metal-containing filler dispersed therein in an amount sufficient to interact with the polymeric release agent having functional groups, said elastomer being cured with a nucleophilic addition curing agent. In this embodiment the preferred range of metal-containing filler, for example lead oxide, is used at a concentration of about 0.5 parts to 100 parts of the metal-containing filler by weight per 100 parts by weight of the elastomer. The most preferred concentration of metal-containing filler is about 5 parts to 45 parts by weight per 100 parts of the elastomer. In the broadest embodiment the metal-containing filler must be present in the elastomer in a concentration greater than about 0.05 volume percent based upon the volume of the elastomer.

There is also provided in a heated pressure fusing system for fixing toner images in an electrostatic reproducing apparatus in which a fuser roll and a backup roll define a contact arc to fuse toner images onto a substrate and a release agent is applied to the surface of the fuser roll to prevent toner offset upon the fuser roll, the improvement comprising a fuser roll having an elastomer surface with metal-containing filler dispersed therein, the elastomer being cured with a nucleophilic addition curing agent, the release agent applied upon the surface of the elastomer being a polymeric release agent having functional groups which interact with the metal in the filler. The preferred elastomers in this embodiment are the fluoroelastomers.

While the mechanism is not completely understood, it has been observed that when certain polymeric fluids having functional groups are applied to the surface of a fuser member having an elastomer surface with metal oxide, metal salt, metal, metal alloy or other suitable metal compound filler dispersed therein, there is an interaction (a chemical reaction, coordination complex, hydrogen bonding or other mechanism) between the metal of the filler in the elastomer and the polymeric fluids having functional groups, so that the polymeric release agent having functional groups in the form of a liquid or fluid provides an excellent surface for release while having an excellent propensity to remain upon the surface of the fuser member. Regardless of the mechanism, there appears to be the formation of a film upon the elastomer surface which differs from the composition of the elastomer and the composition of the polymeric release agent having functional groups. This film, however formed, has a greater affinity for the elastomer having metal oxide, metal salts, metal, metal alloy or other suitable metal compound filler dispersed therein than the toner and thereby provides an excellent release coating upon the elastomer surface. The release coating has a cohesive force which is less than the adhesive forces between heated toner and the substrate to which it is applied and the cohesive forces of the toner. Even though metal oxide, metal salts, metal and metal alloy particles on the surface of the elastomer normally cause release failure, i.e. offset of toner, the use of the polymeric release agents having functional groups upon the surface of the elastomer containing metal oxide, metal salt, metal or metal alloy filler has substantially reduced offset problems which are common to fusing devices and processes of the prior art having fuser members with an outer surface of an elastomer or resinous material. The functional group (of the polymeric release agent) metal (of the metal-containing filler) interaction leads to an overall diminution of the critical or high surface energy of the metal in the metal-containing filler.

Polymeric release agents having functional groups are well known in the prior art. They are described in U.S. Pat. Nos. 4,029,827, 4,078,285, 4,011,362, 4101,686 and 4,046,795. The polymeric release agents having functional groups as used in this invention may be a solid or a liquid at ambient temperature and a fluid at operating temperatures. By using the term "polymeric" is meant two or more monomer units as a backbone having chemically reactive functional groups attached thereto or attached to side chains and branches of the backbone of the polymer. The reactive functional groups attached to the polymer must be capable of interacting with the metal of the filler dispersed in the elastomer surface of the fuser member. Furthermore, the polymeric release agent having functional groups must form a film or barrier upon the surface of the fuser member, which barrier or film has a surface energy less than the surface energy of the toner at operating temperatures. As used herein metal-containing filler means any metal, metal alloy, metal oxide, metal salt or other metal compound which can be incorporated in the elastomer, and which can interact with the polymeric release agent having functional groups. Since the metal of the metal-containing filler must interact with the functional groups of the polymeric release agent, it may be designated as a reactive metal-containing filler. Metal-containing fillers include metals, metal alloys, metal oxides and metal salts.

In the process and devices of the present invention, it is critical that the polymeric release agent have functional groups (also designated as chemically reactive functional groups) which interact with the metal-containing filler dispersed in the elastomer or resinous material of the fuser member surface to form a thermally stable film which releases thermoplastic resin toner and which prevents the thermoplastic resin toner from contacting the elastomer material itself. It is also critical that the metal oxide, metal salt, metal, metal alloy or other suitable metal compound filler dispersed in the elastomer or resin upon the fuser member surface, be a metal oxide, metal salt, metal, metal alloy or other suitable metal compound capable of interacting with the functional groups of the polymeric release agent. Such metal-containing filler materials preferably do not cause gellation of or have any adverse effect upon the polymeric release agent having functional groups.

DESCRIPTION OF THE PREFERRED EMBODIMENTS

Figure 1:
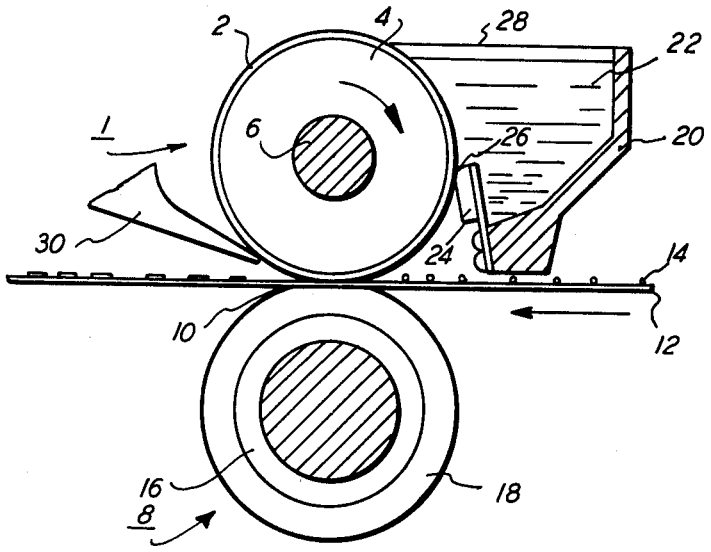
FIG. 1 is a typical side elevational view of a fuser system for a xerographic reproducing apparatus.

The fuser embodiments of the present invention may be used in any xerographic reproducing or duplicating machine using heated roll fusers. Exemplary of an automatic xerographic reproducing machine is the machine described in U.S. Pat. No. 3,937,637. Therein is illustrated a reproducing machine which employs an image recording drum-like member, the outer periphery of which is coated with a suitable photoconductive material. One type of photoconductive material is disclosed in U.S. Pat. No. 2,970,906. The photoconductive drum is suitably journalled for rotation within a machine frame by means of a shaft which rotates to bring the image retaining surface thereon past a plurality of xerographic processing stations. Suitable drive means are provided to power and coordinate the motion of the various cooperating machine components whereby a faithful reproduction of the original input scene information is recorded upon a sheet of final support material such as paper or the like.

Since the practice of xerography is well known in the art, the various processing stations for producing a copy of an original are represented as stations A to E. Initially the drum moves the photoconductive surface through a charging station A. At charging station A an electrostatic charge is placed uniformly over the photoconductive surface of the drum preparatory to imaging. The charging may be provided by a suitable corona generating device. Thereafter, the drum is rotated to exposure station B where the charged photoconductive surface is exposed to a light image of the original input scene information, whereby the charge is selectively dissipated in the light exposed regions to record the original input scene in the form of a latent electrostatic image. A suitable exposure system may be provided by one skilled in the art.

After exposure, the photoconductive drum rotates the electrostatic latent image recorded on the photoconductive surface to development station C, where a conventional developer mix is applied to the photoconductor surface rendering the latent image visible. A suitable development station may include a magnetic brush development system utilizing a magnetizable developer mix having carrier granules and toner comprising electrophotographic resin plus colorant from dyes or pigments. A developer mix is continuously brought through a direction flux field to form a brush thereof. The electrostatic latent image recorded on the photoconductive surface is developed by bringing the brush of developer mix into contact therewith. The developed image on the photoconductive surface is then brought into contact with a sheet of final support material within a transfer station D, and the toner image is transferred from the photoconductive surface to the contacting side of a final support sheet. The final support material may be plain paper, gummed labels, transparencies such as polycarbonate, polysulfone, Mylar, and the like. Mylar is a trademark of E. I. duPont Company.

After the toner image has been transferred to the sheet of final support material, also described herein as a substrate, the sheet or substrate with the image thereon is advanced to a suitable fuser assembly which fuses the transfer powder image thereto. After the fusing process, the final support material is advanced by a series of rolls to a copy paper tray for subsequent removal therefrom by a machine operator. Although most of the toner powder is transferred to the final support material or substrate, some residual toner remains on the photoconductive surface after the transfer of the toner powder image to the substrate. The residual toner particles remaining on the photoconductive surface after the transfer operation are removed from the drum by any one of several well known cleaning means including cleaning corona generating devices used in conjunction with biased resilient knife blades. It is believed that the foregoing description is sufficient for the purposes of the present application to illustrate the general operation of a preferred automatic xerographic copier which can embody the fuser members and methods of the present invention.

In accordance with the present invention, the surface for fixing or fusing a thermoplastic resin powder image to a substrate at elevated temperatures may be either a roll, a flat surface, a belt or any other suitable configuration. However, in accordance with the present invention, the surface of the fuser member must comprise an elastomer having a metal oxide, metal salt, metal, metal alloy or other suitable metal compound filler dispersed therein. The metal-containing filler must be one which can interact with the polymeric release agent having functional groups applied to the fuser member surface to provide a surface abhesive to tackified toner and to release molten thermoplastic resin powder therefrom during the fusing operation, and the metal-containing filler dispersed in the elastomer must be present in an amount sufficient to interact with the polymeric release agent having functional groups. Although the invention is applicable to almost any type of surface which may be used in fixing or fusing a thermoplastic resin powder image to a substrate, for convenience, descriptions set forth herein are directed to fuser roll members which are substantially cylindrical in shape.

The fuser members may be constructed entirely of the elastomer having the metal containing filler dispersed therein, however, in the preferred embodiments, the roll structure comprises a base member made of a hollow cylindrical metal core such as copper, aluminum, steel and the like or coated layers of copper, steel, and aluminum and the like, having a working surface of elastomer having metal-containing filler, such as metal oxide, metal salt, metal or metal alloy, dispersed therein. The base member may be any suitable material having an elastomer layer adhered thereto, and the design is not limited to any particular metal, non-metal or composite.

The elastomers which may be used in accordance with the present invention must be heat stable elastomer or resin materials which can withstand elevated temperatures generally from about 90° C. up to about 200° C. or higher depending upon the temperature desired for fusing or fixing the thermoplastic resin powder to the substrate. The elastomers used in the present invention must resist degradation or attack by the particular polymeric release agent having functional groups which is used to promote release of the molten or tackified thermoplastic resin powder or toner from the fuser member surface. Exemplary of the elastomers which may be used in accordance with the present invention are the fluoro-silicone elastomers, the silicone carborane elastomers, various other silicone rubbers, fluoroelastomers, vinylidene fluoride-based elastomers, various organic rubbers such as ethylene/propylene diene, fortified organic rubbers which resist degradation at fusing temperatures, various copolymers, block copolymers, copolymer and elastomer blends, and the like. Any elastomer or resin used in accordance with the present invention must have thermal oxidative stability, i.e., resist thermal degradation at the operating temperature of the fuser member. Thus the organic rubbers which resist degradation at the operating temperature of the fuser member may be used. These include chloroprene rubber, nitrile rubber, chlorobutyl rubber, ethylene propylene terpolymer rubber (EPDM), butadiene rubber, ethylene propylene rubber, butyl rubber, butadiene/acrylonitrile rubber, ethylene acrylic rubber, sytrene/butadiene rubber, and the like or the foregoing rubbers fortified with additives which thermally stabilize the rubber at least at the operating temperature of the fuser member. Most fuser members are operated at temperatures from about 90° C. to about 200° C. but higher or lower temperatures are also contemplated depending upon the softening or melting point of the toner. Resins having the foregoing properties may also be used in accordance with the present invention. For example, polytetrafluoroethylene (PTFE), fluorinated ethylene-propylene copolymer (FEP) and polyfluoroalkoxypolytetrafluoroethylene (PFA Teflon) may also be used in accordance with the present invention.

The preferred elastomers useful in the present invention are the fluoroelastomers and the most preferred fluoroelastomers are the vinylidene fluoride-based fluoroelastomers which contain hexafluoropropylene as a comonomer. Two of the most preferred fluoroelastomers are (1) a class of copolymers of vinylidene fluoride and hexafluoropropylene known commercially as Viton A, and (2) a class of terpolymers of vinylidene fluoride, hexafluoropropylene and tetrafluoroethylene known commercially as Viton B. Viton A and Viton B and other Viton designations are trademarks of E. I. duPont de Nemours and Company. Other commercially available materials include Fluorel 2170 Fluorel 2174, Fluorel 2176, Fluorel 2177, Fluorel LVS76, Viton GH, Viton E60C, Viton B910, Viton E430. Fluorel is a trademark of 3M Company. Mixtures of the foregoing vinylidene fluoride-based fluoroelastomers with tetrafluoroethylene, with silicone rubber, with fluorosilicone rubber and the like may also be compounded. Any suitable heat resistant elastomer or resin may be used in accordance with the present invention as long as it is resistant to physical and chemical degradation from the particular polymeric release agent having functional groups used as the release agent and as long as the particular metal oxide, metal salt, metal, metal alloy or other metal compound filler of fillers which interact with the polymeric release agent having functional groups can be dispersed therein in a sufficient amount to produce the chemical interaction between the metal oxide, metal salt, metal, metal alloy or other metal compound and the polymeric release agent having functional groups. As used herein the term elastomer is used interchangeably with resin. Although it is not critical in the practice of the invention the molecular weight range may vary from a low of about 1,000 to a high of aout 200,000. The most preferred embodiments, the vinylidene fluoride-based fluoroelastomers have a molecular weight range of about 50,000 to about 100,000, the molecular weight of commercially available Viton E430 being about 75,000.

The most preferred elastomers especially fluoroelastomers having metal, metal alloy, metal salt, metal oxide or other metal compound in accordance with the present invention are those elastomers which can be cured by a nucleophilic addition cure of crosslinking agent or agents. Crosslinking with basic nucleophiles (nucleophilic addition) is well known in the art, but the elastomers having metal, metal alloy, metal salt, metal oxide or other metal compound fillers therein and cured with basic nucleophiles result in improved fuser members. Fuser members having these preferred elastomers with metal, metal alloy, metal salt or metal oxide fillers therein have about a ten fold reduction in wear rate and demonstrate the improved release of the present invention when the metal, metal alloy, metal salt or metal oxide filled elastomers are used upon the surface of the fuser member. At the same time the elastomer layer containing metal, metal alloy, metal salt or metal oxide filler or mixtures thereof provides a conformable surface which improves copy quality even at high rates of speed such as 7,000 copies per hour.

The basic nucleophile cure system is disclosed and discussed in various journals and articles including a paper entitled "VITON FLUOROELASTOMER CROSSLINKING BY BISPHENOLS" written by W. W. Schmiegel and presented at the South German Meeting of the Deutsche Kautschuk Und Gummi Gesellschaft, Apr. 28–29, 1977. One example of the nucleophilic addition cure system is the bisphenol crosslinking agent with organophosphonium salt accelerator. The phosphonium salt may be exemplified as:

$$\phi_3{}^{\oplus}PCH_2\phi$$
$$Cl^{\ominus}$$

where $\phi$ represents phenyl groups, and the bisphenol is exemplified as:

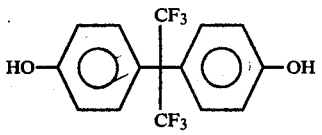

Another example of the nucleophilic addition cure system is crosslinking with a diamine carbamate type curing agent commonly known as DIAk 1. The following scheme showing three separate reactions represents the curing of poly(vinylidene fluoride-hexafluoropropylene) with diamine carbamate as the curing or crosslinking agent:

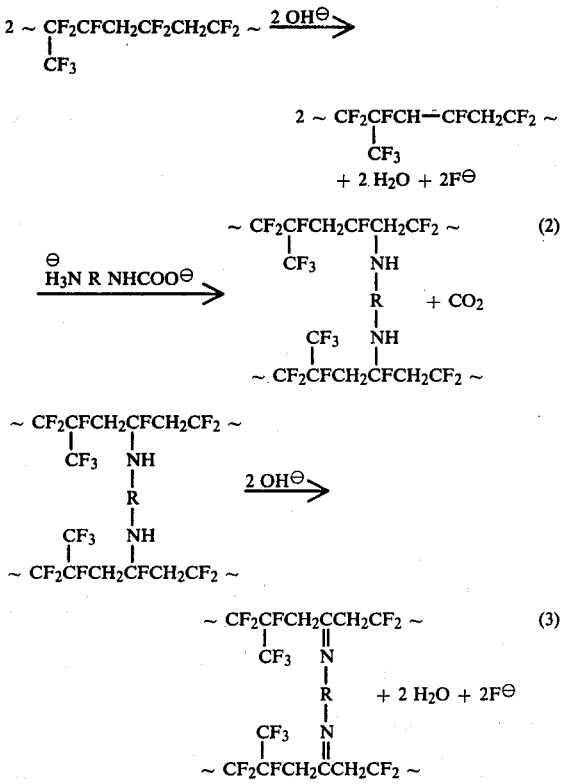

where step 1 shows the loss of HF in the presence of a base; step 2 shows the insertion of the diamine carbamate agent; and step 3 shows post cure in the presence of heat. This mechanism is well known in the art as a crosslinking or curing system. Examples of diamine carbamate cure systems are hexamethylenediamine carbamate known commercially as DIAK No. 1 and N,N'-dicinnamylidene-1,6-hexanediamine known commercially as DIAK No. 3 (DIAK is a trademark of E. I. duPont de Nemours & Co.).

Although other conventional cure or crosslinking systems may be used to cure the elastomers and resins useful in the present invention, for example, free radical initiators such as the peroxide cure system, the nucleophilic addition system is the preferred curing system, especially for fluoroelastomers, in the present invention. By nucleophilic addition curing system is generally meant the use of a bifunctional agent such as a bisphenol or a diamine carbamate to generate a covalently crosslinked network polymer formed by the application of heat following basic dehydrofluorination of the copolymer. Some of the commercially available fluoroelastomer polymers which can be cured by the nucleophilic addition system are Viton E60C, Viton B910, Viton E430, Viton A, Viton B, Fluorel 2170, Fluorel 2174, Fluorel 2176 and the like. Viton is a trademark of E. I. duPont de Nemours & Company, and FLUOREL is a trademark of 3M Company.

The metal oxide, metal salt, metal, metal alloy or other metal compound fillers which may be used in accordance with the present invention, will vary depending upon the particular polymeric release agent having functional groups used as a release agent in the fusing assembly. The metal-containing fillers may be dispersed in the elastomer in any suitable manner, but in the preferred embodiments the metal-containing filler is uniformly dispersed throughout the elastomer layer, coating or body. In certain cases, especially where the fuser member is externally heated and the thickness of the elastomer may be a millimeter or greater in thickness, the metal-containing filler may be dispersed or disposed only proximal the working surface of the fuser member as desired to provide metal at or near the surface for interaction with the polymeric release agent having functional groups. The metal of the metal-containing filler dipsersed in the elastomer may be easily selected by one skilled in the art without undue experimentation by testing the metal-containing filler, such as a metal, metal alloy, metal oxide, metal salt or other metal compound, in an elastomer. The general classes of metals which are applicable to the present invention include those metals of Groups, 1*b*, 2*a*, 2*b*, 3*a*, 3*b*, 4*a*, 4*b*, 5*a*, 5*b*, 6*b*, 7*b*, 8 and the rare earth elements of the Periodic Table. The metal-containing fillers include the oxides, the salts and the alloys of the metals in foregoing groups of the Periodic Table. In certain instances, especially in salts and alloys, certain metals of group 1*a* of the Periodic Table are also included as metal-containing fillers in accordance with the present invention.

The metal oxide filler dispersed in the elastomer may be any metal oxide which can be incorporated in the elastomer without adverse effect upon the elastomer or upon the polymeric release agent having functional groups. Obviously, the release characteristics of the polymeric release agent having functional groups will vary depending upon the particular metal oxide filler dispersed in the elastomer surface because of the kinetics of the interaction between the particular metal oxide and the particular functional group or groups, and it will also depend upon the elastomer material itself. This invention will also produce superior release when certain preferred metal oxide fillers are used. For example, the advantages of this invention can be obtained when the metal oxide filler dispersed in the elastomer is an oxide of aluminum, copper, tin, zinc, lead, iron, platinum, gold, silver, antimony, bismuth, zinc, iridium, ruthenium, tungsten, manganese, cadmium, mercury, vanadium, chromium, magnesium and nickel and alloys thereof. One skilled in the art can compare the release of various elastomers containing these metal oxides to determine the optimum metal oxide or combinations thereof and concentrations thereof. For example, when the polymeric release agent is one having mercapto functional (thiofunctional) groups, the most preferred metal-containing fillers such as the metal oxides, are those which interact with the sulfur in the mercapto-functional group to form metal sulfides. In those embodiments where thermal conductivity is of significance, the preferred metal oxide fillers are those which have greater thermal conductivity. Thus, more desirable metal oxide fillers dispersed in the elastomer material may comprise copper, silver, gold, lead, and the like.

When the metal fillers are incorporated in the elastomer, any stable metal or metal alloy may be used as long as there is no adverse effect upon the elastomer or the polymeric release agent having functional groups and as long as the metal or metal alloy interacts with the functional group or groups of the polymeric release agent. In general, the preferred metals are discussed above relative to their location in the Periodic Table of the Elements. Certain metal or metal alloy fillers will produce superior release when incorporated in the elastomer over other metals or metal alloys, and one skilled in the art can compare the release of various fuser members made in accordance with this invention to determine which metals or metal alloys produce optimum results. Exemplary of the metal or metal alloy fillers useful in the present invention are aluminum, brass, copper, tin, zinc, lead, beryllium, beryllium/copper, steel, iron, platinum, gold, silver, bronze, monel, iridium, ruthenium, tungsten, vanadium, cadmium, chromium, manganese, magnesium, zinc, bismuth, antimony, nickel and alloys of the foregoing metals.

Metal salts may also be incorporated as the metal-containing filler in the elastomers in accordance with the present invention. Any stable salt or salts of the metals discussed relative to their location in the Periodic Table of Elements capable of interacting with the functional group or functional groups of the polymeric release agent may be used an an elastomeric filler as long as there is no adverse effect upon the elastomer or the polymeric release agent having functional groups. For example, when the functional group of the polymeric release agent is a mercapto or thio group, then the metal salt must be able to interact with the sulfur in the mercapto or thio group to form a metal sulfide interaction product. Thus, a metal salt such as lead carbonate, lead iodide or lead fluoride would interact with the sulfur in the mercapto or thio group to form a lead sulfide interaction product. When the functional group of the polymeric release agent is an amino group, then the metal salt must interact with the nitrogen in the amino group to form a metal-nitrogen interaction product. When the functional group of the polymeric release agent is a hydroxyl group, then the metal salt must interact with the oxygen in the hydroxyl group to form a metal-oxygen interaction product. Exemplary of some of the metal salts of the present invention are the acetates, halides (chlorides, fluorides, iodides, and bromides), carbonates, sulfides, sulfates, phosphates, nitrates and the like of lithium, sodium, potassium, calcium, iron, nickel, copper, zinc, aluminum, cadmium, silver, lead, tin, gold, chromium, tungsten and the like. The most preferred metal salts are the salts of heavy metals which form highly insoluble salts, and there is less tendency of such salts to dissolve in the polymeric release agent having functional groups and thereby produce an adverse effect thereon such as gellation. The least preferred metal salts are those which are soluble in the polymeric release agents having functional groups because such salts would become depleted as a function of time, solubility and use from the surface area of the elastomer (the working surface) and thereby diminish the interaction between the metal and the functional group or groups of the polymeric release agent.

In certain embodiments one or more metals, one or more metal alloys, one or more metal oxides or one or more metal salts may be used in the elastomer, or mixtures of any of the foregoing such as one or more metals with one or more metal oxides, or one or more metal oxide with one or more metal salt or one or more metal alloy with one or more metal, and the like may be used in the elastomer in accordance with the present invention.

In certain instances, a particular metal, metal alloy, metal oxide metal salt, or other metal compound may have an adverse effect upon the elastomer or the polymeric release agent having functional groups. For example, it has been determined that calcium oxide causes gellation of mercapto functional polyorganosiloxanes and therefore it is detrimental to the release of thermoplastic resin toners. In other cases certain of the metal containing fillers may lessen the useful life of an elastomer such as when they are soluble in the polymeric release agent and are leached or otherwise depleted from the working surfaces of the elastomer. When these conditions arise, alternative fillers, elastomers and/or polymeric release agents should be used to produce optimum results.

The metal-containing filler may be dispersed in the elastomer material in any suitable or convenient form and manner. The metal containing filler may be in the form of a powder, flakes, spheroids, fibers or any suitable particulate form. It is preferably uniformly dispersed in the elastomer during the compounding of the elastomer, for example, when the elastomer is in the form of a gum, the particulate metal, metal oxide or metal salt or mixture thereof is milled into the gum prior to the curing of the gum to form the elastomer. In general, the metal containing filler is dispersed in the elastomer layer by mixing the selected particulate metal, metal alloy, metal oxide, metal salt or other metal compound or mixtures thereof with the elastomer gum or other millable form of the elastomeric compound preferably prior to solution or homogenization before application to the base member or other surface undergoing coating. The metal-containing filler may be dispersed in the elastomer by conventional methods known to those skilled in the art, as by any suitable means of stirring or blending the particulate metal, metal alloy, metal oxide, metal salt or other metal compound which is generally in the form of a powder or flakes, into the dissolved elastomer, homogenized elastomer or gum. After this dispersion is made, the elastomer gum having the metal-containing filler and the curing agent dispersed therein is then coated upon the base member, for example a cylindrical fuser roll, or any other suitable surface used in making fuser members by any conventional means. Conventional gum compounding agents and solvents may be chosen by one skilled in the art and depends upon the particular elastomer. For example, the vinylidene fluoride copolymers may be dissolved in polar oxygenated solvents such as ketones, acetates and the like. Organic rubbers are soluble in such solvents as toluene. The surface of the elastomer layer having the metal containing filler dispersed therein must be positioned so that it will contact the thermoplastic resin powder image upon the substrate to which it is to be fused or fixed at elevated temperatures. In accordance with the present invention, at the surface of the elastomer layer having a metal containing filler dispersed therein, there will be provided by any means well known in the art, a polymeric release agent having functional groups for the prevention of offsetting or sticking of the thermoplastic resin powder resin or toner to the fuser surface as the thermoplastic resin powder image or toner image contacts the fuser surface at elevated temperatures.

The surfaces of the fuser members of the present invention are preferably prepared by applying either in one application or by successively applying to the surface to be coated with the elastomer having metal-containing filler dispersed therein, a thin coating or coatings of the elastomer having metal-containing filler dispersed therein. Coating is most conveniently carried out by spraying, dipping, the like, a solution or homogenized suspension of the elastomer containing the filler. Molding, extruding and wrapping are also alternative techniques which may be used to make fuser members in accordance with the present invention. When successive applications are made to the surface to be coated, it is generally necessary to heat the film-coated surface to a temperature sufficient to flash off any solvent contained in the film. For example, when a fuser roll is coated with an elastomer layer having metal-containing filler dispersed therein, the elastomer having metal containing filler dispersed therein is successively applied to the roll in thin coatings, and between each application, evaporation of the solvent in the film-coated roll is carried out at temperatures of at least about 25° C. to about 90° C. or higher so as to flash off most of the solvent contained in the film. The temperature of evaporation depends upon the solvent system used. When the desired thickness of coating is obtained, the coating is cured and thereby fused to the roll surface. The elastomer having metal containing filler dispersed therein may also be applied as a sleeve to a roll or as a mat to flat or other suitable surfaces. Conventional methods known in the art may be used in providing a surface in accordance with this invention, and the method for coating rollers as taught by Aser et al. in U.S. Pat. No. 3,435,500 may be used.

The metal-containing filler must be present in the elastomer or gum in an amount sufficient to interact with the polymeric release agent having functional groups. This generally comprises an amount greater than about 0.05 volume percent based upon the volume of the elastomer. Preferably, the metal-containing filler or mixtures of metal-containing fillers are present in an amount from about 1.0 to about 15 volume percent based upon the volume of the elastomer. The most preferred range is from about 2.0 volume percent to about 8.0 volume percent. The particle size of the metal-containing filler dispersed in the elastomer is preferably from about 1 to about 10 microns in size, although particle size is not a limiting factor except the size of the particle cannot be greater than the thickness of the elastomer layer or coating unless the particles have one dimension which is less than the thickness of the elastomer coating, for example when the metal containing filler is in the form of a fiber, flake or flat plate dispersed in the elastomer.

The fuser roll members of the present invention may be constructed entirely of the elastomer having metal-containing filler dispersed therein, however, in the preferred embodiments, the roll structure comprises a hollow cylindrical core such as copper, aluminum, steel and the like overcoated with at least two laters of elastomer, at least the outer layer of the elastomer forming the working surface having metal-containing filler dispersed therein. In these embodiments, the elastomer coatings are generally at least 0.5 mil in thickness and more preferably about 4 mils to about 10 mils in thickness. There are many variables which must be taken into consideration in order to provide the most effective fusing operation, and these include such variables as hardness of the fusing surface, thermal conductivity, pressure, roll or contact speed, heat input, heat source and location thereof and the like. The selection and balancing of these variables is well-known in the art and may effect the selection of the particular elastomer, the particular metal-containing filler and the particular polymeric release agent having functional groups which are to be utilized in the fusing process and assembly. In certain instances, there may be a thin elastomer coating (about 1 to 10 mils) containing metal filler and a conformable pressure or backup roll or a thicker elastomer coating (about 25 to 100 mils) used with a hard pressure or backup roll. If the fuser roll is internally heated, and the thicker elastomer coatings are used therein, then in certain instances additional additives may be used in the elastomer to promote thermal conductivity. Conventional adhesives are generally used to adhere elastomer to the core or base member.

Although the metal-containing filler may be directly incorporated or dispersed in the elastomer, in an alternative embodiment, the metal-containing filler may be thoroughly washed and treated before it is dispersed in the elastomer. One of the preferred methods embraces washing or treating the metal-containing filler with the particular polymeric release agent having functional groups to be used in the fuser assembly prior to dispersion of the metal-containing material as a filler in the elastomer. This process may aid in the dispersion of the metal, metal alloy, metal salt, metal oxide or other metal compound filler in the elastomer and may also be used as a means of controlling the interaction between the metal, the elastomer and the release agent having functional groups applied to the surface of the elastomer. Furthermore, it provides an internal source of the release agent and in certain cases eliminates the need for the external application of the polymeric release agent having functional groups.

Other adjuvants and fillers may be incorporated in the elastomer or gum in accordance with the present invention as long as they do not effect the integrity of the elastomer or the interaction between the metal-containing filler and the polymeric release agent having functional groups. Such fillers normally encountered in the compounding of elastomers and gums including coloring agents, reinforcing fillers, cross-linking agents, processing aids, accelerators and polymerization initiators, may be used.

The invention is also directed to a method of fusing thermoplastic resin toner images to a substrate comprising: (a) forming a film of polymeric release agent having functional groups on the elastomer surface of a fuser member at elevated temperatures, said elastomer surface having metal-containing filler dispersed therein in an amount sufficient to interact with the polymeric release agent having functional groups; (b) contacting the toner images on the substrate with the coated, heated elastomer surface for a period of time sufficient to soften the toner; and (c) allowing the toner to cool. The polymeric release agent having functional groups may be applied intermittently or continuously as necessary to maintain release of the molten thermoplastic resin toner and to prevent offsetting. The thickness of the film of polymeric release agent having functional groups is not critical, however, in preferred embodiments, the film is maintained at about 0.1 to about 2 microns in thickness.

In accordance with the present invention, the working surface of the fuser member is the elastomer having metal-containing filler dispersed therein. As used herein "working surface" of the fuser member is that surface which contacts the toner to cause the toner to fuse to the substrate upon which it is to be affixed permanently. A release material is applied to the "working surface" to prevent offsetting of the toner, especially heated, molten or tackified toner, to the elastomer surface having metal-containing filler dispersed therein. In accordance with the present invention, these release materials or release agents are polymeric release agents having functional groups which are well known in the art and include the polymer release materials which have reactive functionality and react with the metal-containing filler in the working elastomer surface of the fuser member. Typical of these polymer release materials which have functional groups or reactive functionality are the functionalized polymeric release agents described in U.S. Pat. No. 4,101,686 incorporated herein by reference. In this disclosure, the referenced polymer materials having designated functional groups are applied to a heated fuser member in an electrostatic reproducing apparatus to form thereon a thermally stable layer having excellent toner release properties for electroscopic thermoplastic resin toners. The polyorganosiloxane fluids and other polymeric fluids having functional groups interact with the metal fuser members therein in such a manner as to form an interfacial barrier at the surface of the bare metal fuser member while leaving an unreacted low surface energy release fluid as an outer layer or film. Other release materials are well known in the art and include the polymer release materials which oxidize and react with a metal or metal alloy surface of the fuser member exemplary of which are those described and claimed in U.S. Pat. No. 3,937,637 and U.S. Pat. No. 4,078,285. Other exemplary polymeric release agents having functional groups are those described in U.S. Pat. Nos. 4,046,795, 4,029,827 and 4,011,362. As used herein, that characteristic of the polymeric release agent or material applied to the elastomer having metal-containing filler dispersed therein upon the working surface of a fuser member and designated as "reactive functionality" is defined in the foregoing disclosures, and encompasses those polymers which either oxidize and thereby form a functional group which reacts or interacts with the metal filler in the fuser member surface to form the desired toner release layer, or have a built-in functional group or groups which react or interact with the metal of the filler in the fuser member surface to form the desired toner release layer.

A typical fuser member of the present invention is described in conjunction with a fuser assembly as shown in FIG. 1 where the numeral 1 designates a fuser roll comprising elastomer surface 2 having metal-containing filler dispersed therein (not shown) upon suitable base member 4 which is a hollow cylinder or core fabricated from any suitable metal such as aluminum, anodized aluminum, steel, nickel, copper, and the like, having a suitable heating element 6 disposed in the hollow portion thereof which is coextensive with the cylinder. Backup or pressure roll 8 cooperates with fuser roll 1 to form a nip or contact arc 10 through which a copy paper or other substrate 12 passes such that toner images 14 thereon contact elastomer surface 2 of fuser roll 1. As shown in FIG. 1, the backup roll 8 has a rigid steel core 16 with an elastomer surface or layer 18 thereon. Sump 20 contains polymeric release agent 22 which has chemically reactive functional groups thereon which are capable of interacting with the metal-containing filler dispersed in elastomer surface 2. The polymeric release agent 22 having functional groups thereon, may be a solid or liquid at room temperature, but it is a fluid at operating temperatures. In preferred embodiments, the chemically reactive groups of polymeric release material 22 in sump 20 are mercapto, carboxy, hydroxy, isocyanate, epoxy, and amino. The most preferred polymeric release agents having functional groups thereon used in accordance with the present invention are the mercapto-functional polyorganosiloxanes.

In the embodiment shown in FIG. 1 for applying the polymeric release agent 22 to elastomer surface 2, a metering blade 24 preferably of conventional non-swelling rubber is mounted to sump 20 by conventional means such that an edge 26 thereof contacts elastomer surface 2 to serve as a metering means for applying the release agent 22 having chemically reactive groups to fuser member 1 in its liquid or fluid state. By using such a metering blade, a layer of polymeric release fluid 22 can be applied to elastomer 2 in controlled thicknesses ranging from submicron thicknesses to thicknesses of several microns of release fluid. Thus, by metering device 24, about 0.1 to 2 microns or greater thicknesses of release fluid can be applied to the surface of elastomer 2. In the embodiment shown, a pair of end seals 28, for example, of sponge rubber, are provided to contain the release material 22 in sump 20. One or more stripper fingers 30 may be provided for insuring removal of the substrate 12 from the surface of elastomer 2.

Figure 2:
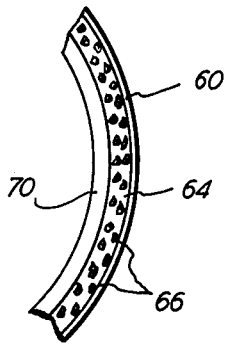
FIG. 2 is a fragmentary view of a fuser member of the present invention.

Referring to FIG. 2, there is shown a fragmentary view of part of the fuser member of the present invention magnified many times over the member shown in FIG. 1 in order to show the thin layers of the fuser member surface. In FIG. 2, the base member or other solid structure upon which the elastomer is applied is designated by numeral 70. Elastomer 64 is deposited upon base member 70 by any suitable means such as curing elastomer 64 containing metal-containing filler 66 directly upon base member 70 or most preferably by using various adhesive materials to cause the adhesion of elastomer 64 containing metal filler 66 to base member 70 or by fitting a sleeve of elastomer 64 containing metal filler 66 to base member 70 by any suitable means or by any other manner as desired. As described above, base member 70 is preferably a metal, but it may also be glass or any other suitable material, or as described above the entire fuser member may comprise the elastomer having metal-containing filler therein and the heating element may be external (not shown) rather than internal. The metal-containing filler particles 66 shown in FIG. 2 are illustrated as having irregular shapes, however, any form of metal may be used in elastomer 64 including powders, flakes, platelets, spheroids, fibers, ovoid particles and the like. A film of polymeric release agent having functional groups is shown on the surface of elastomer 64 and is designated by numeral 60.

The thickness of the elastomer having metal-containing filler dispersed therein is not critical in the practice of the present invention. Generally where the fuser member is heated by internal means, the elastomer having metal filler therein is preferably of such thickness as to constitute a minimal thermal barrier to heat radiating from inside the fuser member to the outermost layer of elastomer having metal filler therein. Recommended thicknesses are generally greater than 0.5 mil (0.00127 cm), but may be from 1 mil (0.0025 cm) to about 200 mils (0.5 cm), the most preferred ranges being from about 4 mils (0.01 cm) to about 100 mils (0.25 cm). The preferred thickness depends upon the fuser member configuration and the particular backup or pressure member (hard or conformable) being used with the fuser member.

The release agent may be applied by any suitable means. The sump is illustrated in the drawing, however, the polymeric release agent having functional groups may be applied by spraying from jets or other orifices, by padding from a flat, contoured or other shaped pad made of fabric, sponge, felt or other suitable material, by metering with an applicator roller or series of applicator rollers, or by means of a belt, by means of a solid bar or blade of the release agent material wiping against the fuser members, or by any other suitable applicator means or device. An applicator roll or applicator belt having an elastomer surface with metal-containing filler dispersed therein may also be used to apply the polymeric release agent having functional groups.

The adhesive or primer layer upon the base member to promote the adhesion of elastomer thereto, for example the adhesion of the elastomer to the metal of the base member, is not critical. Anyone skilled in the art can easily select one of many well-known commercial adhesives or primers for adhering particular elastomers or resins to substrates. For example, silicone rubbers are often adhered to substrates with such primers as vinyltrimethoxysilane, gamma-methacryloxypropyltrimethoxysilane and vinytris (t-butylperoxy) silane and partially hydrolyzed products thereof. Organic rubbers may be adhered to the core material by a primer/rubber adhesive system such as Chemlok 205/236 which may be applied to a metal core. Chemlok 205 is a mixture of polymers, organic compounds and mineral fillers in a methyl isobutyl ketone solvent system. Chemlok 220 and 236 may be used with Chemlok 205 when the bond must have exceptional resistance to adverse environmental conditions. Chemlok 220 is also used as a single coat adhesive for bonding nitrile elastomers. Dissolved organic polymers and dispersed fillers in a xylene and perchloroethylene solvent system may be used for bonding uncured elastomers to metals during vulcanization. One commercial embodiment of this primer is known as Chemlok 220. Chemlok 608 and other well-known dissolved silane polymers are excellent primers for the fluoroelastomers. Chemlok is a trademark of Hughson Chemical Company. Commercial epoxy compounds are also excellent for the bonding of elastomers to metal, plastic and glass substrates. One family of epoxy adhesives orcements is known commercially by the trademark Thixon. Thixon 300 is an epoxy resin well suited for bonding fluoroelastomers such as the Viton elastomers to metal. Thixon is a trademark of Dayton Chemical Products Laboratories.

The following examples further define and describe fuser rolls prepared by the present invention and illustrate the preferred embodiments of the present invention.

EXAMPLE I

A solution of silicone resin is prepared by mixing the silicone resin with toluene. About 50 grams of Ventron micron-sized copper particles are washed with toluene and dried. The dried copper particles are dispersed in the toluene solution of silicone resin, and after the particles are evenly dispersed throughout the solution, the solution is sprayed on the surface of an aluminum cylinder coated with a conventional silane adhesive material known commercially as Chemlok 608. This results in a fuser roll similar to the type shown in FIG. 1. The ratio of copper particles to silicone resin is about 5 volume percent. The roll prepared in the foregoing manner is placed in a fuser assembly as shown in FIG. 1 and is used with a mercapto-functional polyorganosiloxane release agent having a molecular weight of about 14,000 and a mercapto (-SH) concentration of about 0.17 weight percent (based upon the weight of the mercapto-functional polyorganosiloxane). The life of the fuser roll is suitable and excellent release of thermoplastic resin toner is observed with the foregoing fuser roll having copper particles dispersed in silicone rubber. No hot offset is observed when this fuser roll heated at 180° C. is used to fix toner images to paper.

EXAMPLE II

A fuser roll was prepared in accordance with the procedure of Example I except the micron-sized copper particles (50 grams) were reacted with 100 mils of a mercapto-functional polyorganosiloxane having a molecular weight of 14,000 and a mercapto content of about 0.17 weight percent for 1 hour at 149° C. The copper particles were then separated from the mercaptofunctional polyorganosiloxane fluid, washed with toluene and dried. The dried copper particles (representing about 5 volume percent of the silicone resin) were evenly dispersed in a solution of silicone resin in toluene and sprayed on an aluminum cylinder coated with the adhesive material of Example I.

The foregoing roll was placed in a fixture similar to that shown in FIG. 1 except that no release agent fluid was placed in the sump, and there was no external application of any release agent. About 7,000 copies were fused with this fuser member before offset occurred.

EXAMPLE III

A fuser member was prepared in accordance with Example I except the elastomer was poly(vinylidene fluoride-hexafluoropropylene) copolymer having a molecular weight of about 100,000 and identified as Viton A. The copolymer was dissolved in methyl ethyl ketone solvent. Excellent release was obtained when particles of silver having an average particle size of about 2 microns were present in the poly(vinylidene fluoride-hexafluoropropylene) at a concentration of about 1.5 weight percent based upon the weight of the elastomer, and the fuser roll was used in a configuration similar to the fuser assembly shown in FIG. 1 with a release agent of mercapto-functional polyorganosiloxane blended with polydimethylsiloxane, the blend having a molecular weight of about 11,500 and a mercapto content of about 0.17 weight percent.

EXAMPLE IV

A fuser roll is made similar to the fuser roll described in Example III except the elastomer is poly(vinylidene fluoride-hexafluoropropylene-tetrafluoroethylene) known under the trade name of Viton B. Excellent release is obtained when about 9 percent (by weight based upon the weight of the elastomer) of micron-sized copper particles similar to the copper particles of Example I, is used. Excellent release of thermoplastic resin toner is observed when the mercapto-functional polyorganosiloxane of Example I is used as the release agent in a fuser assembly similar to that shown in FIG. 1.

EXAMPLE V

A fuser member was prepared in accordance with Example III except the elastomer was a poly(vinylidene fluoride-hexafluoropropylene) known commercially as Viton E430 (Viton is a trademark of E. I. duPont de Nemours and Co.). The elastomer contained 45 parts by weight lead oxide per 100 parts by weight of the elastomer. In excess of 150,000 copies were fixed in the Xerox 9200 duplicator (Xerox and 9200 are trademarks of Xerox Corporation) using a mercapto-functional polyorganosiloxane release agent having a mercapto content of 0.04 weight percent (based upon the weight of the polyorganosiloxane).

EXAMPLE VI

A fuser member is prepared in accordance with Example III except the elastomer is poly(vinylidene fluoride-hexafluoropropylene copolymer) known as Viton A cured by a bisphenol curing agent. About 6 percent (by weight based upon the weight of the elastomer) of lead carbonate is dispersed in the elastomer by blending on a rubber mil prior to dissolving in methyl ethyl ketone. Suitable release of thermoplastic resin toner is obtained when mercapto-functional polyorganosiloxane is used as the release agent in the fuser assembly similar to that shown in FIG. 1.

EXAMPLE VII

A fuser roll was prepared by coating an aluminum cylinder having an epoxy adhesive known commercially as Thixon 300 thereon, with a solution of Viton GH containing an aliphatic peroxide curing agent. Only trace amounts (less than 1 part by weight based upon the weight of the elastomer) of metal-containing filler were incorporated or dispersed in the poly(vinylidene fluoridehexafluoropropylene) terpolymer known as Viton GH to assist the cure. The elastomer was cured at 232° C. for 24 hours and was placed in a fuser assembly similar to the one shown in FIG. 1. A 250 centistoke polyorganosiloxane fuser oil(polydimethylsiloxane) was used as the release agent. Less than 1,000 copies were fused with this system before release failure.

EXAMPLE VIII

A fuser roll identical to the fuser roll of Example VII was prepared with only a trace amount of a metal-containing filler to assist curing. Instead of the linear polydimethylsiloxane (silicone oil) used as the release agent in Example VII, a branched silicone oil (branched polydimethylsiloxane having branching of the siloxane backbone) having a viscosity of about 250 centistokes was used. There was only some improvement over the number of copies fused when conventional silicone oil was used as the release agent.

EXAMPLE IX

A fuser roll identical to the fuser roll of Example VII having an elastomer coating of Viton A cured with a diamine carbamate curing system (DIAK No. 1) and having only trace amounts of metal-containing filler to assist the cure was used. A mercapto-functional polyorganosiloxane fluid having a viscosity of about 250 centistokes, a molecular weight of about 11,500 and a mercapto content of about 0.06 percent (based upon the weight of the polyorganosiloxane) was used as the release agent. Although substantially more copies were fused with the fuser member and release agent of this example over the fuser member and release agent of Example VIII, the results were still less than desirable.

EXAMPLE X

A fuser roll having a 1.5 mil layer of Viton E430 with a metal-containing filler was placed upon an aluminum roll having the epoxy adhesive of Example VII thereon identical to the procedure and roll of Example VII except there was an intermediate 6.0 mil layer of Viton E60C coated upon the epoxy covered aluminum roll. All conditions were identical to the conditions of Example VII except a metal-containing filler, lead oxide, was incorporated into the 1.5 mil thick poly(vinylidene fluoride-hexafluoropropylene) copolymer known as Viton E430 prior to curing with a bisphenol curing system. The lead oxide was about 45 parts per 100 weight of the Viton E430 (7.5 percent by volume). The release agent used in the sump was identical to the release agent used in Example IX. Nearly 1,000,000 copies were fused with the fuser member and the mercapto-functional polyorganosiloxane release agent before release failure was observed.

A comparison of the results of Example VII through Example X shows the remarkable improvement of the present invention when a metalcontaining filler is incorporated in the elastomer used as the surface coating of a fuser member when the polymeric release agents having functional groups are used as release agents to fuse thermoplastic resin toner images to substrates such as paper. The number of copies which can be fused with the metal-containing filler in the elastomer are multiples of hundreds of thousands more than the same fuser member containing no filler or only trace amounts of filler in the elastomer even when the system is used with the same polymeric release agent having functional groups.

EXAMPLE XI

The aluminum cylinder fuser roll core having a diameter of 2.984 inches (7.58 cm) taken from a Xerox 9200 copier) Xerox and 9200 are trademarks of Xerox Corporation) was degreased, grit blasted, degreased and covered with an epoxy adhesive known commercially as Thixon 300. Viton E60C containing carbon black and magnesium oxide was sprayed from a methyl ethyl ketone solution upon the epoxy-coated aluminum roll to produce a layer 6 mils thick when cured with a bisphenol curing system. A fluoroelastomer copolymer of poly(vinylidene fluoride-hexafluoropropylene) known as Viton E430 having 45 parts of lead oxide filler per 100 parts by weight of the fluoroelastomer blended therein was dissolved in methyl ethyl ketone solvent. The curing or crosslinking agent for both fluoroelastomers was fluorinated bisphenol A. The solution was repeatedly sprayed upon the degreased aluminum base member or core to yield a final thickness of about 2.0 mils (0.005 cm.). The fluoroelastomer was cured by heating for 16 hours at 232° C. The layer was cooled and sanded. The final thickness of the Viton E430 layer was about 1.5 mils (0.003 cm.). The roll was placed in a Norman abrader and wear data was recorded. Another roll prepared identical to that shown above was placed in a Xerox 9200 duplicator having a wick applicator for applying the release agent to the roll (Xerox and 9200 are trademarks of Xerox Corporation) and tested for wear data and release. About 500,000 copies were fused by the roll in the xerographic duplicator using the polymeric release agent of Example IX. The wear data taken from the xerographic duplicator showed less than 0.05 mils of wear per 100,000 copies and the Norman abrader showed 100 microinches of wear per 40 cycles.

EXAMPLE XII

Two rolls identical to those described in Example XI were prepared for this experiment except the rolls were coated with a fluoroelastomer terpolymer of poly(vinylidene fluoride-hexafluoropropylene-tetrafluoroethylene) having a copolymerized cure site monomer conferring greatly enhanced curability with aliphatic peroxide systems. The fluoroelastomer contained 45 parts by weight lead oxide per 100 parts by weight of the fluoroelastomer. The fluoroelastomer commercially available under the trade designation Viton GH (a trademark of E. I. duPont Company)was cured with a conventional aliphatic peroxide curing agent. These rolls were also tested in a Norman abrader and in a Xerox 9200 duplicator (Xerox and 9200 are trademarks of Xerox Corporation). A wear rate of 0.4 mils of Viton GH per 100,000 copies was observed in the duplicator, however, 500,000 copies were fused in the duplicator using the mercapto-functional polyorganosiloxane fuser release agent of Example IX applied by a wick applicator conventionally used in the Xerox 9200 duplicator. The wear rate observed in the modified paper abrasion fixture (Norman abrader) for the Viton GH cured with the aliphatic peroxide curing agent was 900 microinches of wear per 40 cycles.

In comparing the data of Examples XI and XII, the magnitude of improvement gained by using the fluoroelastomer cured with the bisphenol curing agent, a nucleophilic addition curing agent, and having the lead oxide metal-containing filler dispersed therein in accordance with the present invention is clearly demonstrated. A comparison of the wear data shows that there is a ten-fold reduction in wear rate while maintaining the desirable release performance when different cure systems are used for the fluoroelastomers containing metal-containing fillers when the fusing process is carried out with a polymeric release agent having functional groups such as mercapto-functional polyorganosiloxane.

EXAMPLE XIII

A fuser roll similar to the fuser roll of Example XI was prepared for this experiment except only 15 parts by weight per 100 parts of the fluoroelastomer identified commercially as Viton E430 (Viton is a trademark of E. I. duPont Company) was used. All other conditions and materials were identical to those set forth in Example XI. The fuser roll prepared with this poly(vinylidene fluoride-hexafluoropropylene) copolymer showed an even greater improvement in wear rate with acceptable release performance when used with mercapto-functional polyorganosiloxane release agent in a Xerox 9200 copier/duplicator (Xerox and 9200 are trademarks of Xerox Corporation). The Norman abrader showed 40 microinches of wear per 40 cycles.

While the invention has been described with respect to preferred embodiments, it will be apparent that certain modifications and changes can be made without departing from the spirit and scope of the invention and therefore it is intended that the foregoing disclosure be limited only by the claims appended hereto.

What is claimed is:

1. A fuser member for fixing thermoplastic resin powder images to a substrate in a fuser assembly of the type wherein a polymeric release agent having functional groups is applied to the surface of the fuser member, the fuser member comprising a base member having an elastomer surface with metal-containing filler dispersed therein in an amount sufficient to interact with a polymeric release agent having functional groups.

2. The fuser member of claim 1 wherein the metal-containing filler is a powder.

3. The fuser member of claim 1 wherein the metal-containing filler is in the form of flakes.

4. The fuser member of claim 1 wherein the metal-containing filler is in the form of fibers.

5. The fuser member of claim 1 wherein the metal-containing filler is one having a high thermal conductivity and a high surface energy reactivity.

6. The fuser member of claim 1 wherein the metal-containing filler is present in a concentration in the elastomer greater than about 0.05. volume percent based upon the volume of the elastomer.

7. The fuser member of claim 1 wherein the metal-containing filler is present in the elastomer in a concentration of about 1.0 volume percent to about 10.0 volume percent based upon the volume of the elastomer.

8. The fuser member of claim 1 wherein the metal-containing filler is selected from the group consisting of metal, metal alloy, metal oxide and metal salt.

9. The fuser member of claim 8 wherein the metal is selected from the group consisting of copper, tin, silver, zinc, aluminum, iron, lead, molybdenum, platinum, gold, beryllium, nickel, chromium, iridium, ruthenium, tungsten, cadmium and vanadium.

10. The fuser member of claim 8 wherein the metal alloy is selected from the group consisting of alloys of copper, tin, silver, zinc, aluminum, iron, lead, molybdenum, cadmium, platinum, gold, beryllium, chromium, iridium, ruthenium, tungsten, manganese, magnesium and vanadium.

11. The fuser member of claim 8 wherein the metal oxide is selected from the group consisting of oxides of copper, tin, magnesium, manganese, silver, zinc, aluminum, iron, lead, molybdenum, platinum, gold, beryllium, cadmium, nickel, chromium, iridium, ruthenium, tungsten, vanadium, potassium and sodium and alloys thereof.

12. The fuser member of claim 8 wherein the metal salt is selected from the group consisting of lead carbonate, lead acetate, lead iodide, lead chloride, lead fluoride, lead sulfide, lead sulfate, lead nitrate, zinc acetate, zinc chloride, sodium fluoride, sodium acetate, sodium iodide, copper acetate, copper chloride, silver chloride, silver nitrate, silver sulfide, chromium chloride, potassium fluoride and potassium chloride.

13. The fuser member of claim 1 wherein the metal of the metal-containing filler is selected from the group consisting of Groups 1*a*, 1*b*, 2*a*, 2*b*, 3*a*, 3*b*, 4*a*, 4*b*, 5*a*, 5*b*, 6*b*, 7*b*, 8 and the Rare Earth elements of the Periodic Table of the Elements.

14. The fuser member of claim 1 wherein the elastomer is a fluoroelastomer.

15. The fuser member of claim 14 wherein the fluoroelastomer is poly(vinylidene fluoride-hexafluoropropylene).

16. The fuser member of claim 14 wherein the fluoroelastomer is poly(vinylidene fluoride-hexafluoropropylene-tetrafluoroethylene).

17. The fuser member of claim 14 wherein the fluoroelastomer is a fluorosilicone rubber.

18. The fuser member of claim 1 wherein the functional groups of the polymeric release agent having functional groups which interact with the metal of the filler, are selected from the group consisting of hydroxy, epoxy, amino, isocyanate, carboxy and mercapto.

19. The fuser member of claim 1 wherein the polymeric release agent having functional groups which interact with the metal of the filler comprises a mercapto-functional polyorganosiloxane.

20. The fuser member of claim 1 further comprising metal-containing filler treated with polymeric release agent having functional groups prior to dispersion of the metal-containing filler in the elastomer.

21. The fuser member of claim 19 wherein the metal-containing filler is treated with the mercapto-functional polyorganosiloxane before the metal-containing filler is incorporated in the elastomer.

22. A method of fusing thermoplastic resin toner images to a substrate comprising:

(a) forming a film of polymeric release agent having functional groups on an elastomer surface of a fuser member at elevated temperatures, said elastomer surface having metal-containing filler dispersed therein in an amount sufficient to interact with the polymeric release agent having functional groups;

(b) contacting the toner images on said substrate with the coated heated elastomer surface for a period of time sufficient to soften the toner; and (c) allowing the toner to cool 23. The method of claim 22 comprising continuously depositing the polymeric release agent having functional groups on the elastomer surface containing the metal-containing filler.

24. The method of claim 22 wherein the thickness of the film is maintained at about 0.1 to about 2 microns.

25. The method of claim 22 wherein the metal-containing filler is selected from the group consisting of metal, metal alloy, metal oxide and metal salt.

26. The method of claim 25 wherein the metal filler is selected from the group consisting of copper, tin, silver, zinc, aluminum, gold, iron, lead, molybdenum, platinum, beryllium, nickel, chromium, iridium, ruthenium, tungsten, cadmium and vanadium.

27. The method of claim 25 wherein the metal alloy is selected from the group consisting of bronze, brass, monel, beryllium/copper and steel.

28. The method of claim 25 wherein the metal alloy is selected from the group consisting of alloys of copper, tin, silver, zinc, aluminum, iron, lead, molybdenum, cadmium, platinum, gold, beryllium, chromium, iridium, ruthenium, tungsten, manganese, magnesium and vanadium.

29. The method of claim 25 wherein the metal oxide is selected from the group consisting of oxides of copper, tin, mangnesium, manganese, silver, zinc, aluminum, iron, lead, molybdenum, platinum, gold, beryllium, cadmium, nickel, chromium, iridium, ruthenium, tungsten, vanadium, potassium and sodium and alloys thereof.

30. The method of claim 25 wherein the metal salt is selected from the group consisting of lead carbonate, lead acetate, lead iodide, lead chloride, lead fluoride, lead sulfide, lead sulfate, lead nitrate, zinc acetate, zinc chloride, sodium fluoride, sodium acetate, copper acetate, copper chloride, silver chloride, silver nitrate, silver sulfide, chromium chloride, potassium fluoride and potassium chloride.

31. The method of claim 22 wherein the metal of the metal-containing filler is selected from the group consisting of Groups 1*a*, 1*b*, 2*a*, 2*b*, 3*a*, 3*b*, 4*a*, 4*b*, 5*a*, 5*b*, 6*b*, 7*b*, 8 and the Rare Earth Elements of the Periodic Table of the Elements.

32. The method of claim 22 wherein the metal-containing filler is a powder.

33. The method of claim 22 wherein the metal-containing filler is in the form of flakes.

34. The method of claim 22 wherein the metal-containing filler is in the form of fibers.

35. The method of claim 22 wherein the elastomer is a fluoroelastomer.

36. The method of claim 35 wherein the fluoroelastomer is poly(vinylidene fluoride-hexafluoropropylene).

37. The method of claim 35 wherein the fluoroelastomer is poly(vinylidene fluoride-hexafluoropropylene-tetrafluoroethylene).

38. The method of claim 35 wherein the fluoroelastomer is a fluorosilicone rubber.

39. The method of claim 22 wherein the elastomer is selected from the group consisting of polytetrafluoroethylene resin, fluorinated ethylene/propylene copolymer resin, and perfluoroalkoxy polytetrafluoroethylene resin.

40. The method of claim 22 wherein the polymeric release agent having functional groups which interact with the metal-containing filler in the elastomer comprises a mercapto-functional polyorganosiloxane.

41. The method of claim 22 wherein the metal-containing filler is present in a concentration greater than about 0.05 volume percent based upon the volume of the elastomer.

42. The method of claim 22 wherein the metal-containing filler is present in a concentration of about 1 volume percent to about 15 volume percent based upon the volume of the elastomer.

43. The method of claim 22 further comprising treating the metal-containing filler with polymeric release agent having functional groups prior to dispensing the metal-containing filler in the elastomer.

44. The method of claim 40 further comprising treating the metal-containing filler with mercapto-functional polyorganosiloxane prior to dispensing the metal-containing filler in the elastomer.

45. In a heated pressure fusing system for fusing toner images in an electrostatic reproducing apparatus in which a fuser roll and a backup roll define a contact arc to fuse toner images onto a substrate and a release agent is applied to the surface of the fuser roll to prevent toner offset from the fuser roll, the improvement comprising a fuser roll having an elastomer surface with metal-containing filler dispersed therein and the release agent applied upon the surface of the elastomer being a polymeric release agent having functional groups which interact with the metal in the filler.

46. The pressure fusing system in accordance with claim 45 wherein the metal-containing filler dispersed in the elastomer is selected from the group consisting of metal, metal alloy, metal oxide and metal salt.

47. The pressure fusing system of claim 45 wherein the polymeric release agent having functional groups is a mercapto-functional polyorganosiloxane.

48. The pressure fusing system of claim 47 wherein the metalcontaining filler is treated with mercapto-functional polyorganosiloxane prior to dispensing the metal-containing filler in the elastomer.

49. The pressure fusing system of claim 40 further comprising metal-containing filler treated with polymeric release agent having functional groups prior to dispersion of the metal-containing filler in the elastomer.

50. The pressure fusing system of claim 45 wherein the elastomer is a fluoroelastomer.

51. The pressure fusing system of claim 50 wherein the fluoroelastomer is poly(vinylidene fluoride-hexafluoropropylene).

52. The pressure fusing system of claim 50 wherein the fluoroelastomer is poly(vinylidene fluoride-hexafluoropropylene-tetrafluoroethylene).

53. The pressure fusing system of claim 45 wherein the metal-containing filler is present in a concentration greater than about 0.05 volume percent based upon the volume of the elastomer.

54. A method of fusing thermoplastic resin toner images to a substrate comprising:

(a) contacting the toner images for a period of time sufficient to soften the toner with the coated, heat elastomer surface of a fuser member, said elastomer having metal-containing filler dispersed therein, said metal-containing filler having been treated with a polymeric release agent having functional groups prior to dispersion in the elastomer; and (b) allowing the toner to cool.

55. The method of claim 54 wherein the polymeric release agent having functional groups is mercapto-functional polyorganosiloxane.

56. The method of claim 54 wherein the elastomer is a fluoroelastomer.

* * * * *